US006454457B1

(12) United States Patent
Banse et al.

(10) Patent No.: US 6,454,457 B1
(45) Date of Patent: Sep. 24, 2002

(54) MIXING APPARATUS WITH ROTARY JET WATER VALVE

(75) Inventors: Michael J. Banse, Walters, OK (US); Paul O. Padgett, Apache, OK (US); Craig Sneed, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 57 days.

(21) Appl. No.: 09/687,556

(22) Filed: Oct. 13, 2000

(51) Int. Cl.[7] ..... B01F 5/04; B01F 5/10

(52) U.S. Cl. ..... 366/136; 366/137.1; 366/167.1; 366/182.4

(58) Field of Search ..... 137/625.32; 366/34, 366/137.1, 182.3, 182.4, 173.2, 167.1, 176.1, 176.2, 136, 137; 422/274, 278; 251/309–312; 239/431, 433, 435, 543, 544, 586, 581.1

(56) References Cited

U.S. PATENT DOCUMENTS 45,369 A * 12/1864 Maitland
304,443 A * 9/1884 Morrison
1,174,897 A * 3/1916 Preston
1,273,349 A * 7/1918 Filbin
2,126,911 A * 8/1938 Mullen
2,224,355 A * 12/1940 Moller
2,423,801 A * 7/1947 Sloan
2,528,514 A * 11/1950 Harvey et al.
2,746,728 A * 5/1956 Pomerleau
3,164,443 A * 1/1965 Watson
3,219,483 A * 11/1965 Goos et al.
3,425,669 A * 2/1969 Gaddis
3,995,839 A * 12/1976 Zingg
4,053,142 A * 10/1977 Johannes
4,531,673 A * 7/1985 Holland et al.
4,774,984 A * 10/1988 Peters
4,801,210 A * 1/1989 Glan
5,046,855 A 9/1991 Allen et al. ..... 366/137
5,492,404 A * 2/1996 Smith
5,538,341 A 7/1996 Padgett et al. ..... 366/134
5,660,466 A * 8/1997 Hopson et al.
5,971,604 A * 10/1999 Linga et al.
6,341,888 B1 * 1/2002 Ekhlom et al.

FOREIGN PATENT DOCUMENTS

FI 92417 B * 7/1994

* cited by examiner

*Primary Examiner*—Charles E. Cooley
*Assistant Examiner*—David Sorkin
(74) *Attorney, Agent, or Firm*—John W. Wustenberg; Anthony L. Rahhal; Craig W. Roddy

(57) ABSTRACT

A mixing apparatus includes a mixing tube, a liquid inlet, a dry substance inlet and a recirculation mixture inlet. The mixing apparatus is utilized with a tub. A liquid and a dry substance may be mixed in the mixing tube and the mixture may be recirculated so that a liquid, a dry substance and a recirculated mixture may all be mixed in a mixing tube and subsequently utilized in a wellbore. The mixing apparatus includes a valve connected to the liquid inlet. The valve comprises a cylindrical outer housing, a jetting sleeve and a rotatable plug therein. The jetting sleeve is disposed in the outer housing and has a plurality of ports which will direct liquid downwardly and inwardly so that it mixes with the dry substance as the dry substance passes downwardly in the mixing tube. The plug may be rotated in the jetting sleeve to completely cover all the jetting ports to prevent flow into the mixing tube and is rotatable to an open position in which liquid may be allowed to flow through the jetting ports. The valve is positioned at the exit of the liquid inlet.

17 Claims, 11 Drawing Sheets

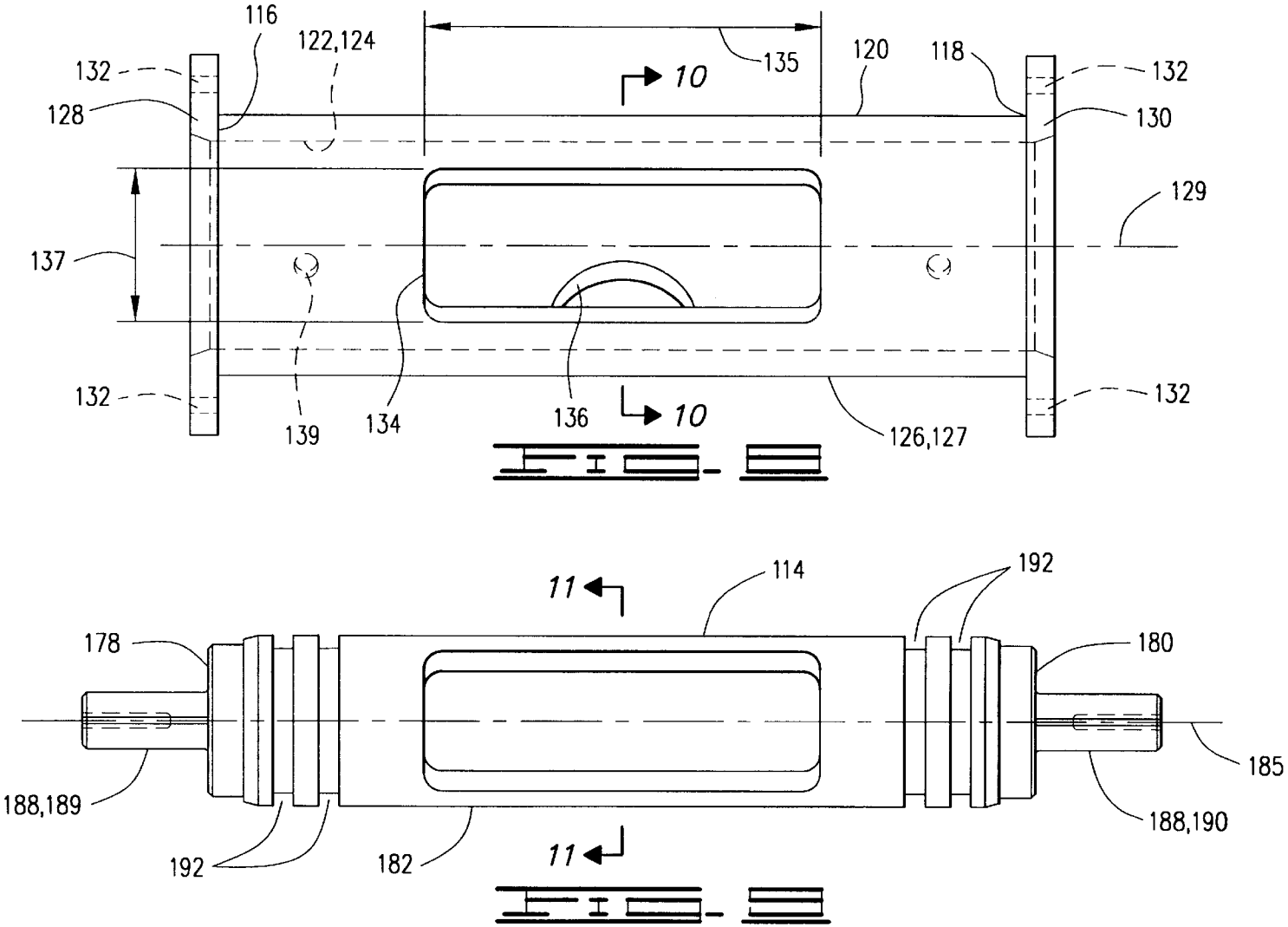
132
130
129
132
118
120
126,127
135
10
10
136
134
122,124
139
116
132
128
137
132
185
188,190
180
192
114
11
11
182
192
178
188,189

MIXING APPARATUS WITH ROTARY JET WATER VALVE

BACKGROUND OF THE INVENTION

This invention relates generally to apparatus and methods for mixing at least two substances, for example but not by way of limitation, dry cement and water. The invention relates more particularly, but not by way of limitation to a mixer incorporating a jet valve which provides increased mixing energy with which a cement slurry can be formed for use in an oil or gas well.

Well drilling and completion operations often require on-site mixing of various substances, such as cement slurries, acids and fracturing gels and weighting drilling fluids. In general, a mixing system includes a tub, pumps and various monitoring and control equipment. Cement slurries must be pumped into wellbores for a variety of reasons, such as for example securing casing in a wellbore. The mixture of cement to be used in a particular well typically is required to have certain characteristics which make the mixture, referred to as a cement slurry, suitable for the downhole environment where it is to be used. The desired type of cement slurry must be accurately mixed and produced at the well location so that it can be pumped into the wellbore.

Prior art apparatus for creating cement slurries include a jet mixer which typically sprays water under pressure into a venturi tube where bulk cement is added. The water and bulk cement combine to form a cement slurry which is conveyed into a tub prior to pumping the slurry down a wellbore. Another prior art mixer is shown in U.S. Pat. No. 5,046,855 (the '855 patent), the details of which are incorporated herein by reference. The '855 patent discloses a mixer with a flat orifice plate and a flat valve plate which can be utilized to regulate water flow. The valve and orifice plates are positioned horizontally in the mixer so that water must be falling downwardly, which is the same direction as the direction of flow of cement, when it engages the valve and orifice plates.

Another mixing apparatus is shown in U.S. Pat. No. 5,538,341 (the '341 patent), the details of which are incorporated herein by reference. The apparatus shown therein discloses a mixing tube with a dry substance inlet, a mixed substances inlet and a liquid inlet. The patent discloses that a water metering valve is to be connected to the liquid upstream from the liquid inlet. Such prior continuous mixing systems work well and have served and continue to serve useful purposes. However, while the prior art apparatus and methods provide satisfactory results, there is always a need for mixing devices which can provide improved efficiency and improved mixing, and which more effectively utilize available mixing energy. The present invention provides such an apparatus.

BRIEF DESCRIPTION OF THE DRAWINGS

FIG. 6 is a section view taken from lines 6—6 of FIG. 3 and shows the jetting valve in its closed position.

FIG. 6A is a section view similar to FIG. 6, but shows the jetting valve in its fully open position.

FIG. 8 is a view of a detail of the outer sleeve of the nozzle of the present invention.

FIG. 9 shows the metering plug of the present invention.

FIG. 12 shows a detail of the jetting sleeve of the valve of the present invention.

FIG. 13 is a section view from lines 13—13 of FIG. 14.

DETAILED DESCRIPTION OF THE PREFERRED EMBODIMENT

Figure 1:
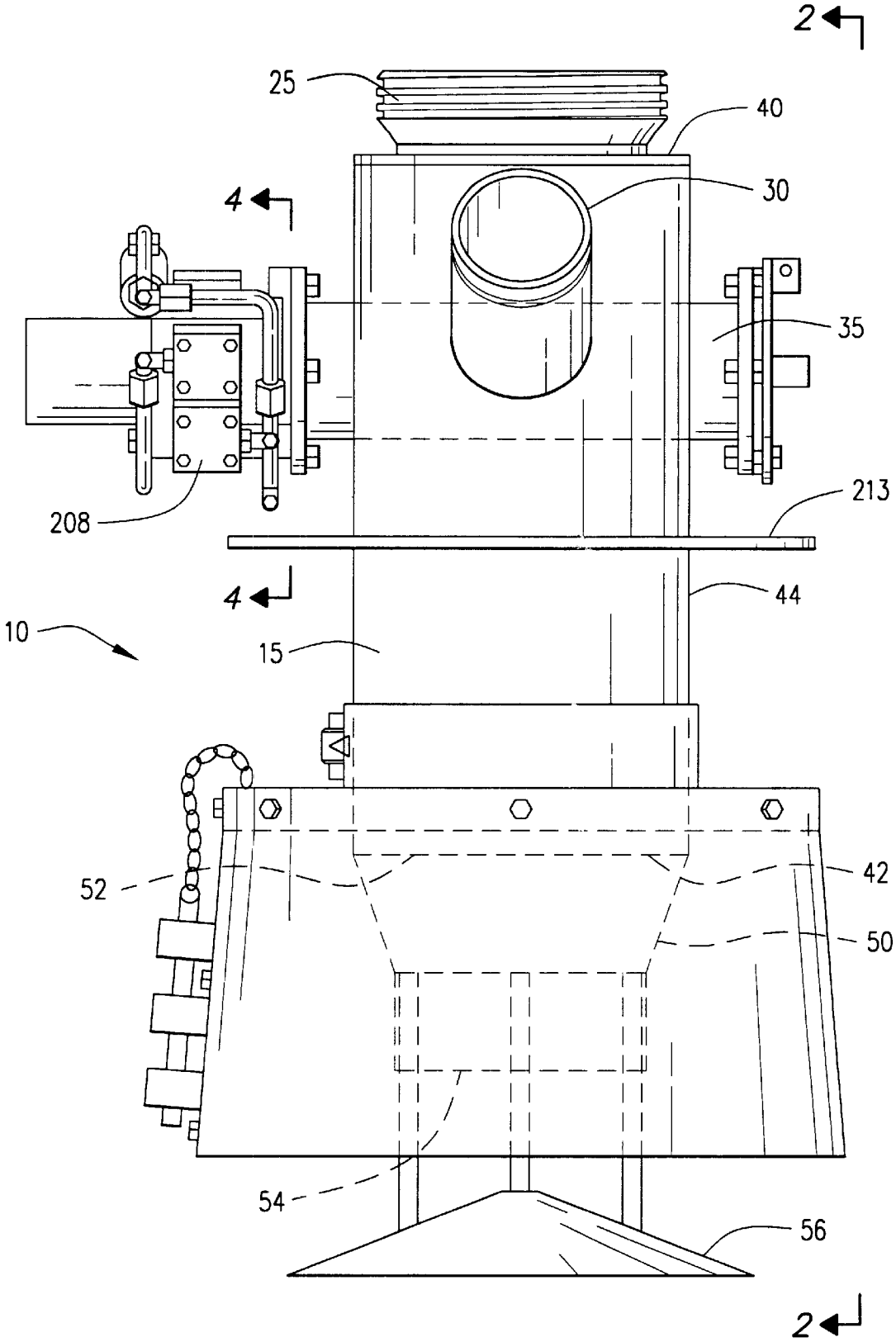
FIG. 1 is a front elevation view of an apparatus of the present invention.
Figure 2:
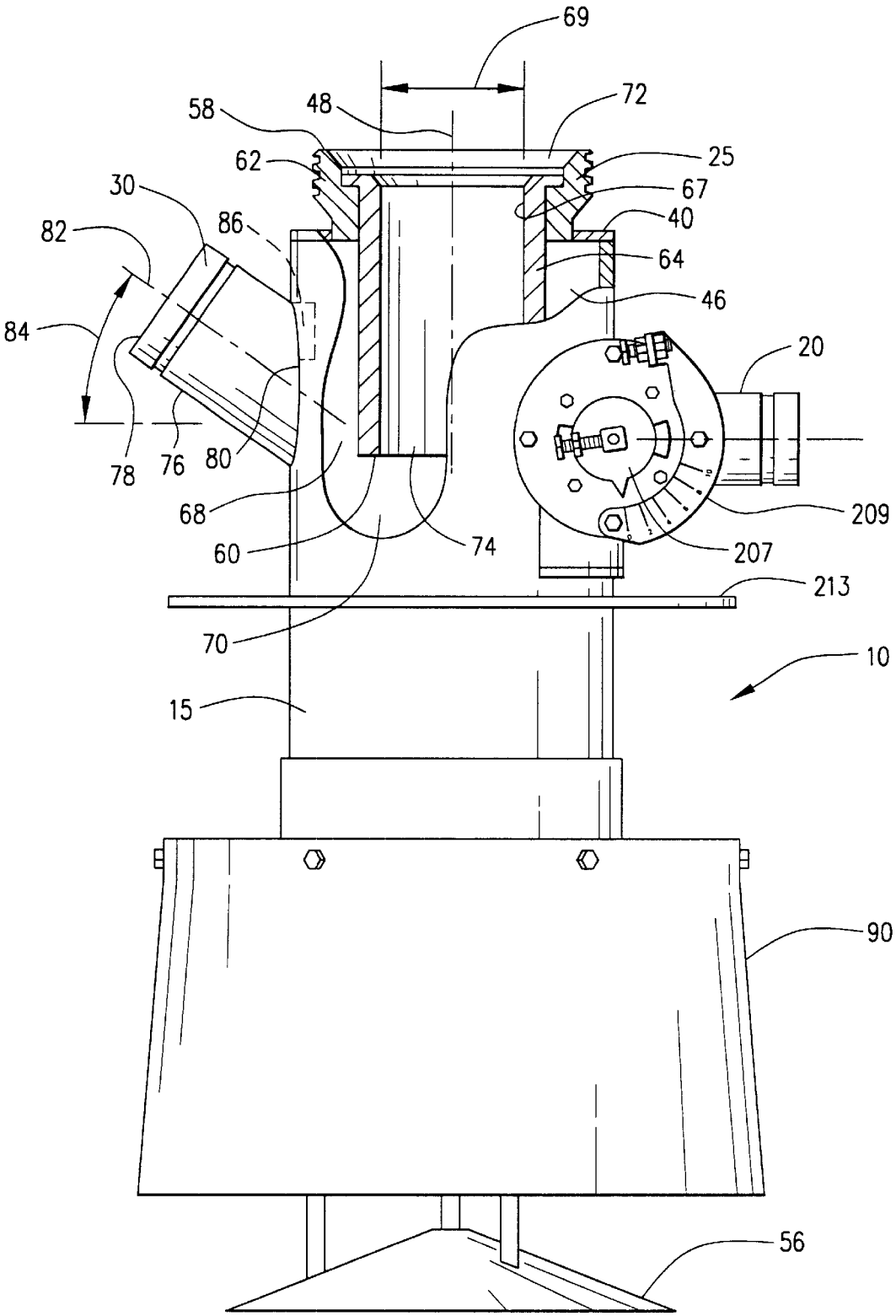
FIG. 2 is a side view of the present invention from lines 2—2 of FIG. 1.
Figure 3:
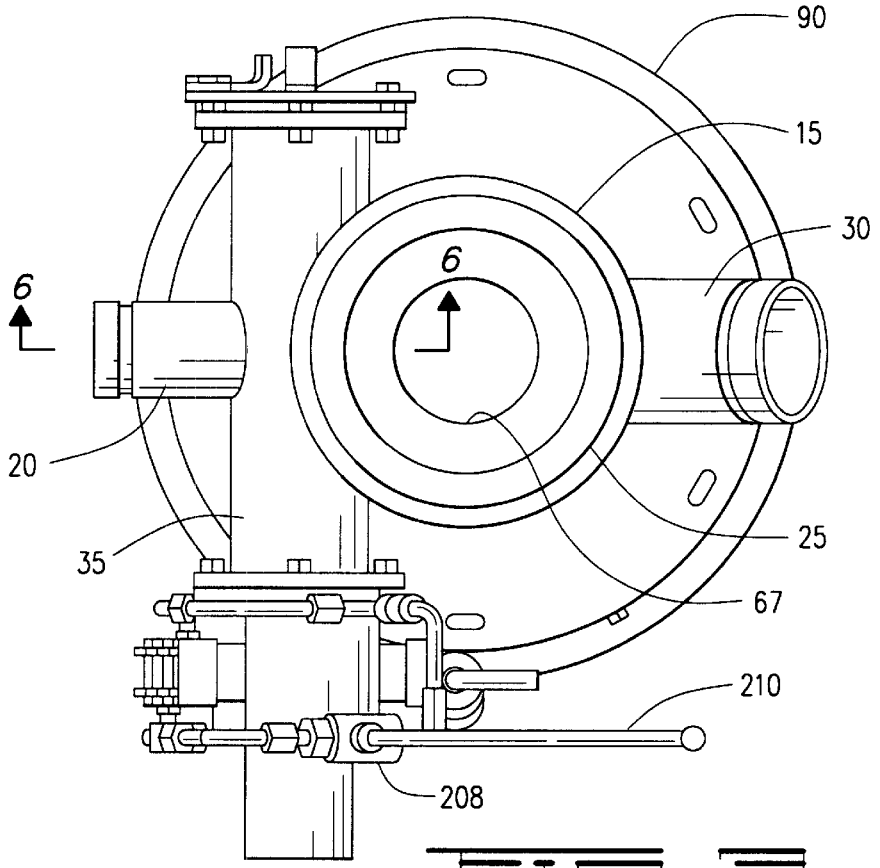
FIG. 3 is a top view of the present invention.

Referring now to the drawings and particularly FIGS. 1–3, a mixing apparatus is shown and generally designated by the numeral 10. Apparatus 10 includes a mixing tube 15, a first or liquid inlet member 20 for conveying the liquid substance into the mixing tube 15, a second or bulk inlet member 25 for conveying the dry substance into the mixing tube 15 and a third or recirculation inlet member 30 for conveying a recirculated mixture into the mixing tube 15. Apparatus 10 also has a rotary valve, or jetting valve 35, for controlling the flow of liquid into the mixing tube 15. Jetting valve 35 is connected to mixing tube 15 and to liquid inlet member 20. Jetting valve 35 has a longitudinal central axis 36. Apparatus 10 thus has means for conveying a liquid substance, a dry substance and a mixture of liquid and dry substances into the mixing tube 15.

Mixing tube 15 has an upper end 40, a lower end 42 and an outer surface 44. Mixing tube 15 is generally cylindrically shaped and defines an interior 46. Mixing tube 15 has a longitudinal central axis 48, which in the position shown in FIGS. 1 and 2 is substantially vertically oriented. A cone shaped funnel 50 is attached to the lower end 42 of mixing tube 15 and has an upper end 52 and an open lower end 54. A deflector cone 56 is positioned below lower end 54 of funnel 50. Deflector cone 56 may be attached to mixing tube 15 or funnel 50.

Bulk inlet member 25 has an upper end 58 and a lower end 60. Upper end 58 is positioned above upper end 40 of mixing tube 15. Bulk inlet member 25 extends downwardly into the interior 46 of mixing tube 15 and is comprised of a threaded collar 62 and a replaceable insert 64. Threaded collar 62 and insert 64 may be like that described in the '341 patent. Bulk inlet 25 has a longitudinal central axis 66 that is preferably collinear with longitudinal central axis 48 of mixing tube 15 and has an inner surface 67 defining a diameter 69. Mixing tube 15 is divided into an upper portion 68 and a lower portion 70 with the dividing line being lower end 60 of bulk inlet member 25. Bulk inlet member 25 has an entry or entry opening 72 at the upper end 58 and an exit or exit opening 74 at the lower end 60.

Recirculation inlet member 30 comprises a generally cylindrical tube 76 having a first or entry end 78 and a second or exit end 80. The orientation and configuration of recirculation inlet member 30 is like that described with respect to the recirculation inlet in the '341 patent. Thus, recirculation inlet member 30 has a longitudinal central axis 82 and is disposed at an angle 84 from horizontal as shown in FIG. 2. Angle 84 is preferably approximately 25°–35° and more preferably about 30°. A recirculation nozzle plate 86 is attached to exit end 80 and covers a portion thereof. Recirculation inlet member 30, due to recirculation nozzle plate 86 and the angle 84, will direct a recirculated mixture conveyed from recirculation inlet member 30 inwardly and downwardly toward lower portion 70 of mixing tube 15. A splash sheath 90 may be connected at or near the lower portion 70 of mixing tube 15 with bolts or other means known in the art.

Liquid inlet member 20 has a first, or entry end 94, a second, or exit end 96 and an outer surface 98 as shown in FIG. 6. Liquid inlet member 20 is comprised of a generally cylindrical member 100 defining an interior 102 and has a longitudinal central axis 103. A liquid entry or liquid entry opening 104 is defined at first end 94, and a liquid exit or liquid exit opening 106 is defined at second end 96. Longitudinal central axis 103 is preferably positioned so as to be substantially perpendicular to longitudinal central axis 48 of mixing tube 15 and thus liquid inlet member 20 is substantially perpendicular to mixing tube 15.

The details of rotary valve 35, which may be referred to as a throttling valve or jetting valve 35, are better seen in FIGS. 5–16. Jetting valve 35 comprises a first or outer sleeve which may also be referred to as an outer housing 110, a jetting sleeve or a jetting cylinder 112 disposed in outer housing 110 and a metering plug or metering sleeve 114 rotatably disposed in jetting sleeve 112.

Jetting valve 35 is shown in FIG. 6 in a closed position 111, wherein no flow is permitted therethrough from liquid inlet member 20 into mixing tube 15 and is shown in a fully open position 113 in FIG. 6A, wherein a maximum flow is permitted. As will be explained in more detail hereinbelow, jetting valve 35 is movable from closed position 111 to fully open position 113 and may be positioned at any desired position therebetween, which may be referred to as a partially open position so that flow therethrough may be regulated. Thus, there are a number of partially open positions, and the jetting valve 35 may be positioned at a selected one of any of said partially open positions. Reference to the open position of the jetting valve 35 and the open position of the metering plug 114 includes any position wherein flow through the jetting valve 35 into the mixing tube 15 is permitted.

Outer sleeve 110 has a first end 116, a second end 118, an outer surface 120 and an inner surface 122 defining an interior 124. Outer sleeve 110 comprises a cylinder or cylindrical portion 126 defining an outer wall 127 and having flanges 128 and 130 at the ends thereof. Outer sleeve 110 has a longitudinal central axis 129. Flanges 128 and 130 have holes or openings 132 to receive bolts or other fasteners known in the art.

Figure 5:
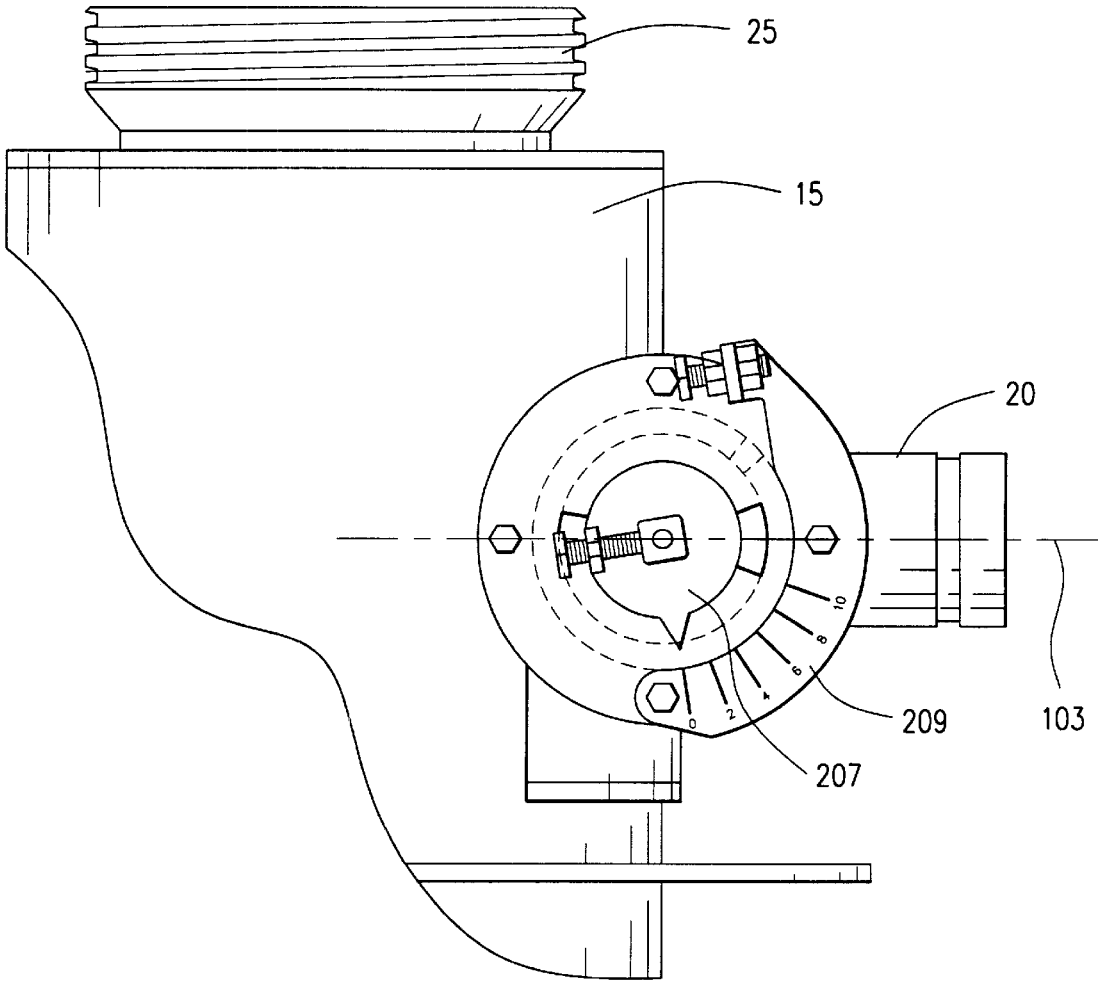
FIG. 5 is an enlarged view of an end plate assembly for the nozzle of the present invention.
Figure 5:
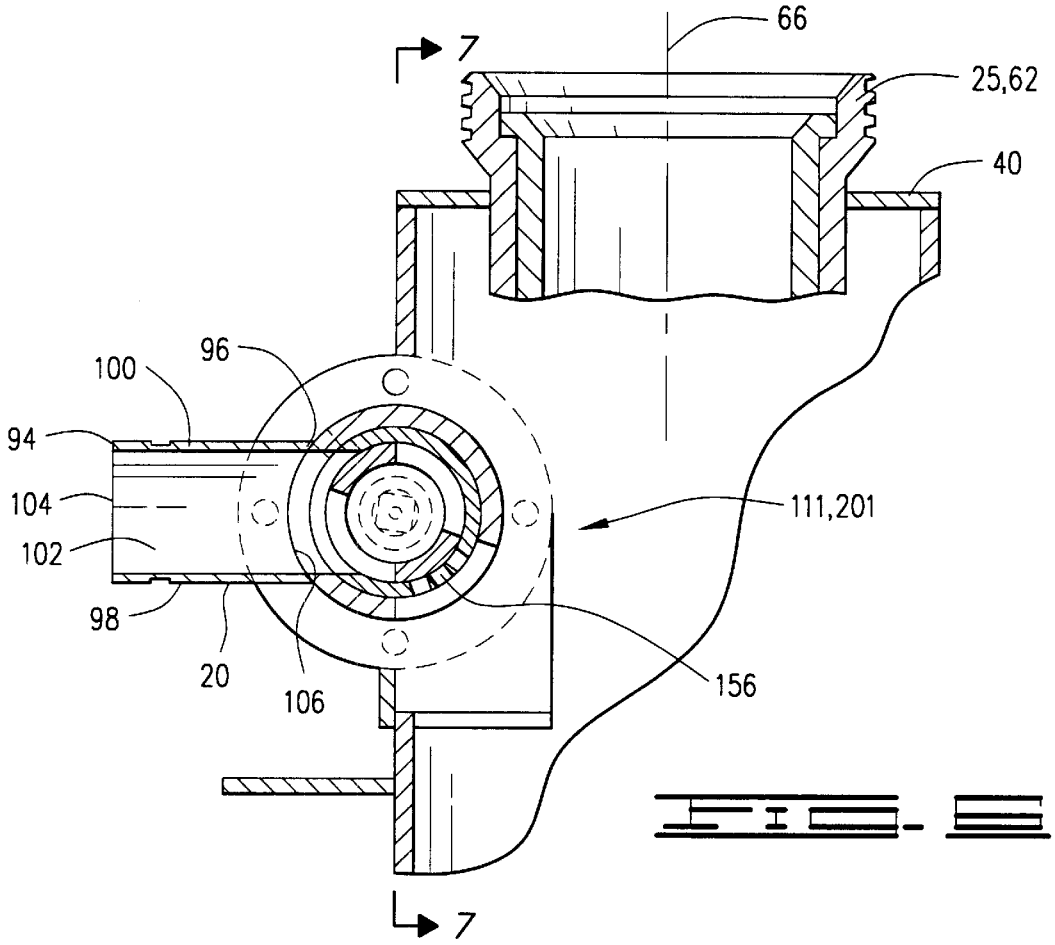
Figure 5A:
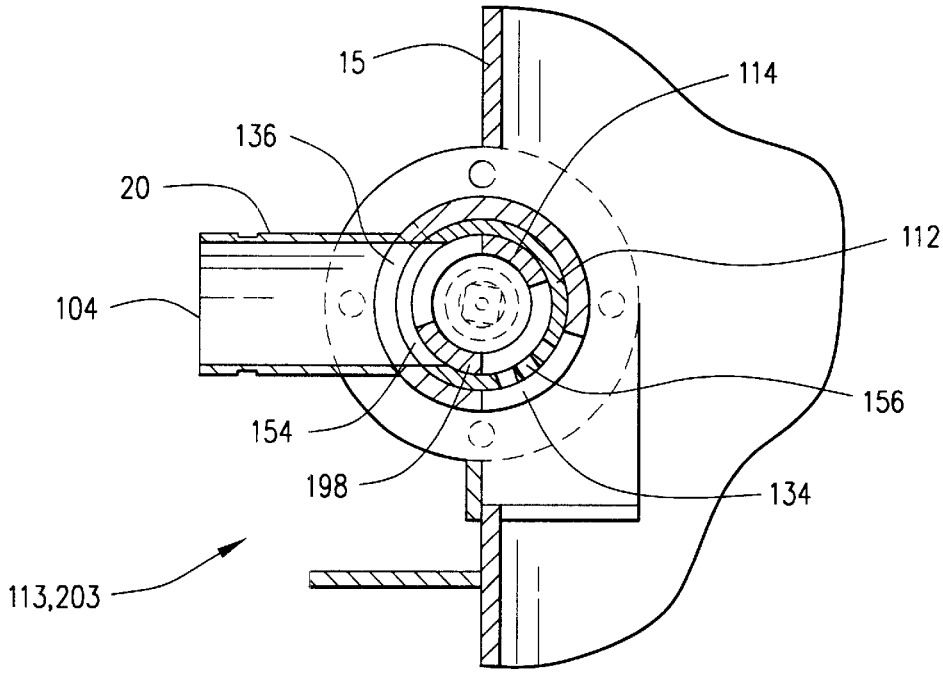

Openings 134 and 136 are defined through outer sleeve 110, preferably through outer wall 127, to provide for communication into and through the interior 124 thereof. Opening 134 appears in the elevation view in FIG. 8 as a generally rectangularly shaped opening with rounded corners and may be referred to as an exit or exit opening 134. Exit opening 134 thus has a length 135 and a width 137. Opening 136 is shaped so that, as shown in FIG. 5, liquid inlet member 20 may be attached by welding or other means known in the art thereto. Thus, liquid may be conveyed through liquid inlet member 20 into outer sleeve 110 through opening 136. Outer sleeve 110 may also contain threaded holes 139. A grease delivering device may be used in connection with holes 139 for seal lubrication.

Jetting sleeve 112 is received in outer sleeve 110. Jetting sleeve 112 is a generally cylindrically shaped sleeve having first and second ends 138 and 140, respectively. Lugs 141 and 143 are disposed at each of ends 138 and 140. Jetting sleeve 112 has an outer surface 142 and an inner surface 144 defining an interior 146. Jetting sleeve 112 has a longitudinal central axis 148.

Figure 7:
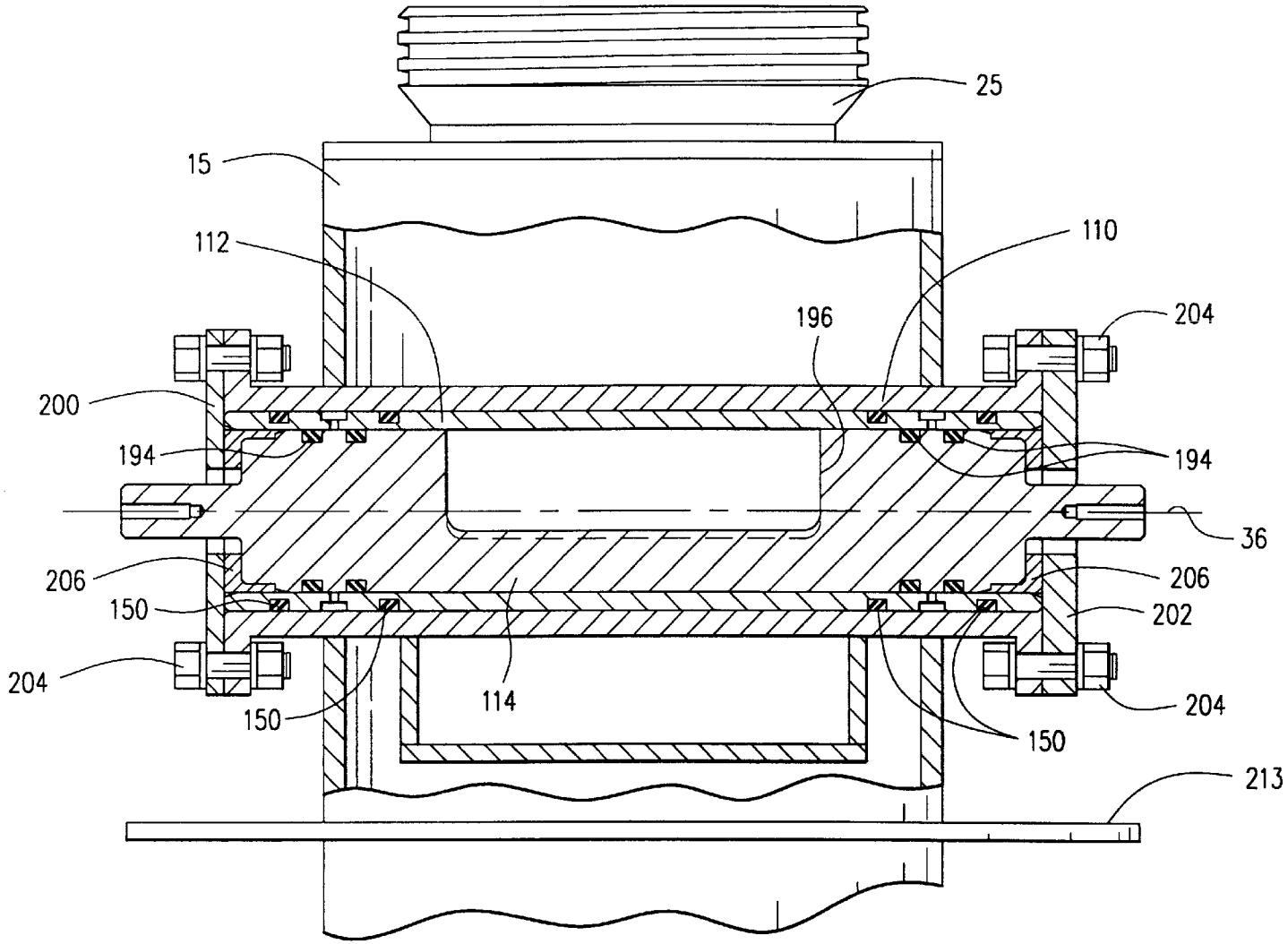
FIG. 7 is a section view taken from lines 7—7 of FIG. 6.
Figure 10:
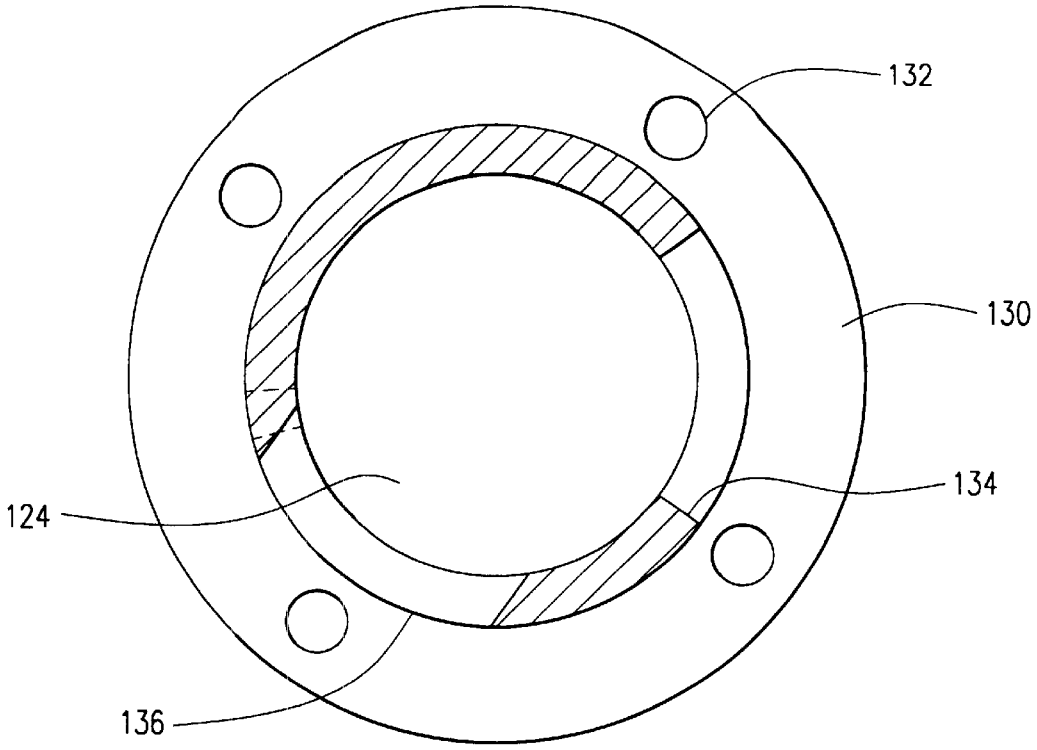
FIG. 10 is a section view from lines 10—10 of FIG. 8.

A plurality of grooves 149 are defined in outer surface 142 and, as shown in FIG. 7, receive seals 150. Grooves 152 having holes 153 therethrough are also defined in outer surface 142. There are preferably six holes 153 spaced around the circumference of each of grooves 152. Grooves 152 may contain grease or other lubricating substances. Holes 153 will deliver the lubricating material to the seals disposed about metering plug 114. Since metering plug 114 rotates, lubrication of the seals around the metering plug is important. Seals 150 on the jetting sleeve 112 serve to force the lubricating material into holes 153.

Figure 14:
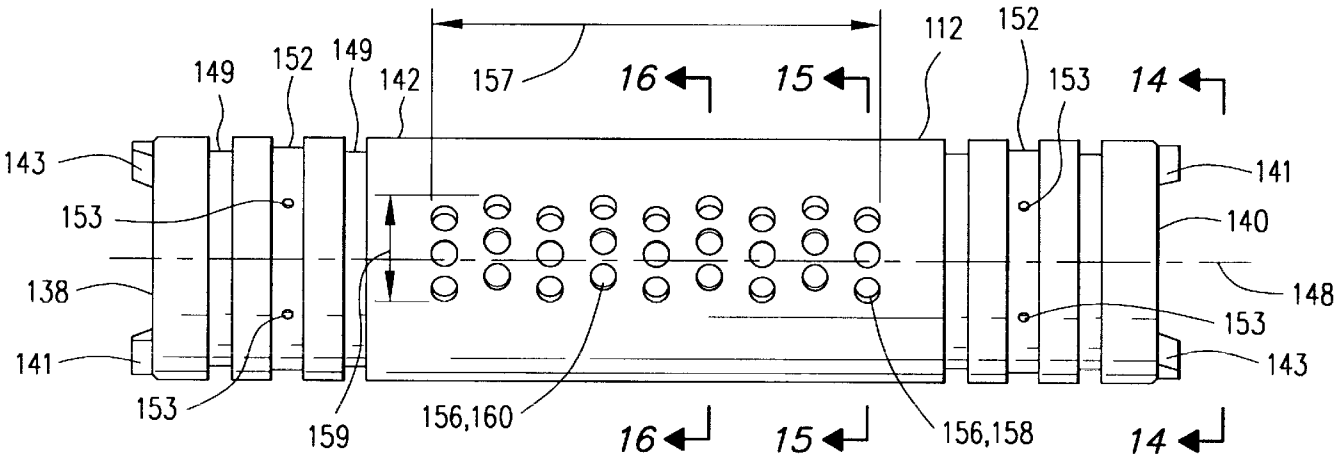
FIG. 14 is an end view of the jetting sleeve shown in FIG. 12.

Jetting sleeve 112 has an entrance or entrance opening 154 which as viewed in FIG. 13 is a circular opening. Entrance opening 154 is positioned so that it will align with the opening 136 in outer sleeve 110. Jetting sleeve 112 has a plurality of jetting ports 156 defined through the wall thereof. Jetting ports 156 are arranged in a plurality of columns 158 and 160, and collectively define a width 157 and a length 159. Width and length 135 and 137, respectively, of exit opening 134 are preferably such that none of jetting ports 156 are covered by outer sleeve 110. In other words all of the jetting ports 156 will fit within opening 134. Columns 158 and 160 are arranged such that adjacent columns are offset from one another as shown in FIG. 12. The position of the jetting ports 156 is defined with respect to a centerline 162 which goes through the center of entrance opening 154. The position of the jetting ports 156 may be explained with reference to an angle 164 which as shown in FIG. 14 is preferably approximately 120° measured from the centerline 162.

Figure 15:
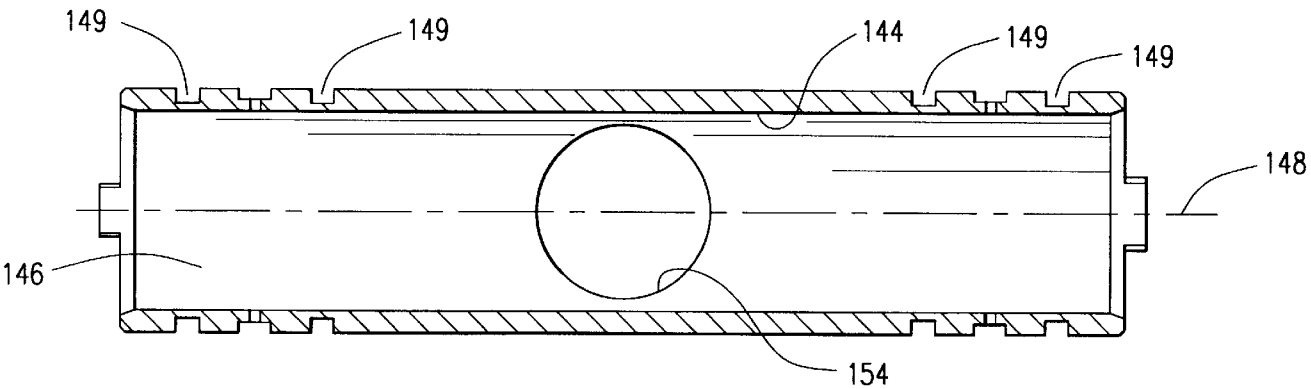
FIGS. 15 and 16 are section views taken from lines 15—15 and 16—16 of FIG. 12, respectively, and show the orientation of the hole patterns in the jetting sleeve.
Figure 14:
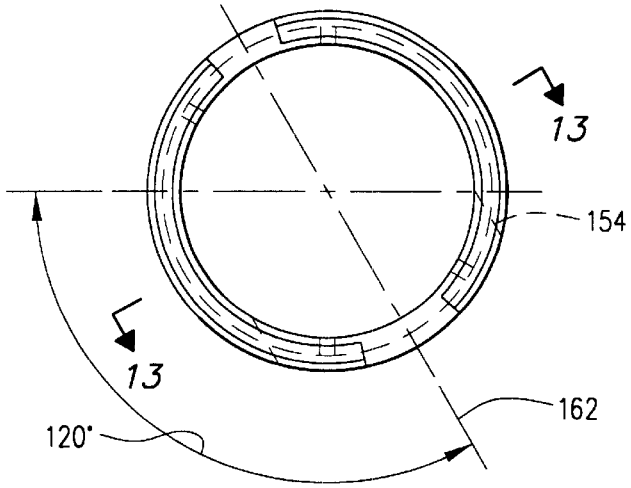
Figure 15:
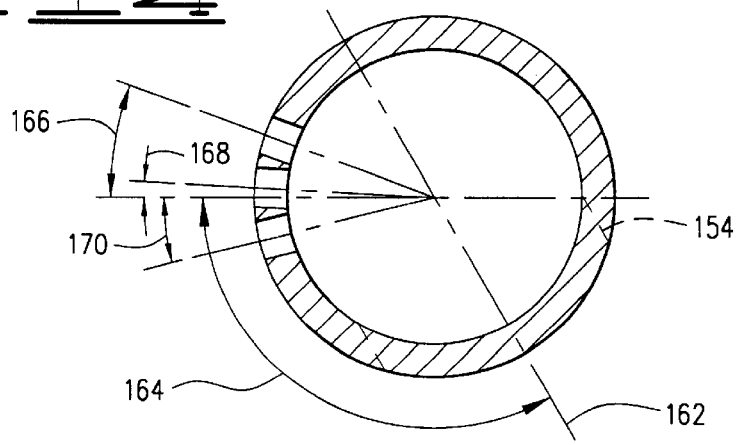
Figure 16:
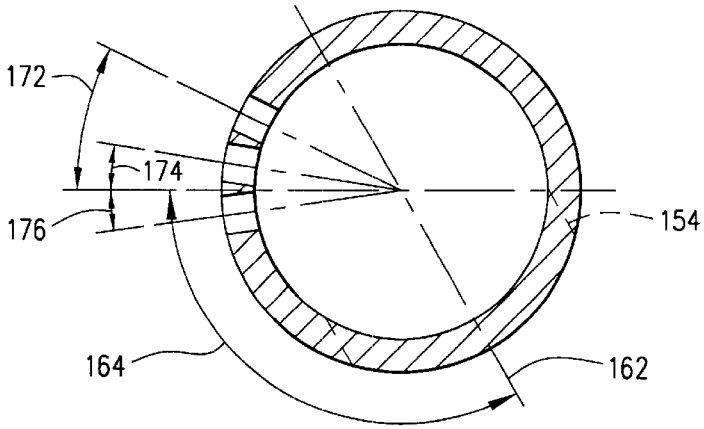

As shown in FIG. 15, the jetting ports 156 in columns 158 are positioned so that the centerlines are displaced at angles 166, 168 and 170, respectively, from angle 164. Angle 166 is preferably from about 17°–23° and is more preferably about 20°. Angle 168 is preferably from about 0°–6° and is more preferably about 3°. Angle 170 is preferably from about 11°–17° and is more preferably about 14°.

Likewise, the jetting ports 156 in columns 160 have centerlines at angles 172, 174 and 176, respectively. Angle 172 is preferably from about 23°–29° and is more preferably about 26°. Angle 174 is about 6°–12° and is more preferably about 9°. Angle 176 is preferably about 5°–11° and is more preferably about 8°. As is apparent in FIG. 6A, jetting sleeve 112 is positioned so that opening 154 aligns with opening 136 in outer sleeve 110. Jetting ports 156 are all positioned so that liquid passing therethrough will enter the mixing tube 15 through opening 134 and will direct the liquid downwardly and inwardly so that it intersects any dry substance entering the mixing tube 15 below the exit opening 74 of bulk inlet member 25.

Figure 11:
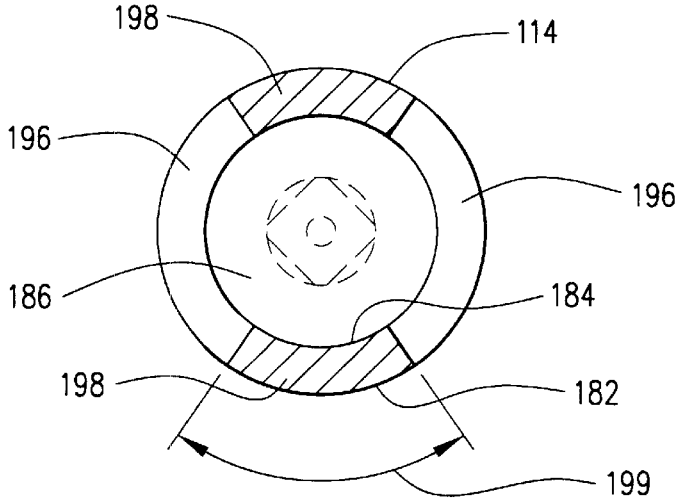
FIG. 11 is a section view from lines 11—11 of FIG. 9.

Metering plug 114, which is rotatably disposed in jetting sleeve 112, may be described with reference to FIGS. 9 and 11. Metering plug 114 has first and second ends 178 and 180, and has an outer surface 182, an inner surface 184 and a longitudinal central axis 185. Longitudinal central axes 129, 148 and 185 are collinear, and are collinear with longitudinal central axis 36 of jetting valve 35. Metering plug 114 also defines an interior 186.

Shaft extensions 188, which may be referred to as first and second shaft extensions 189 and 190 extend from first and second ends 178 and 180, respectively. First and second shaft extensions 189 and 190 are preferably square shafts. A plurality of grooves 192 are defined in metering plug 114. As shown in FIG. 7, grooves 192 have seals 194 disposed therein for sealingly engaging jetting sleeve 112. Seals 194 may be lubricated with lubrication material delivered through holes 153 in jetting sleeve 112. Metering plug 114 has windows 196 defined therethrough which define plugging strips 198. Plugging strips 198 extend through a peripheral distance 199 sufficient to completely cover jetting ports 156 as will be explained in more detail hereinbelow.

Referring now back to FIGS. 6 and 7, outer housing 110 is fixedly attached to mixing tube 15 by welding or other means known in the art. Jetting valve 35 has end plates 200 and 202 attached to outer sleeve 110 with bolts 204 or with other means known in the art. Jetting sleeve 112 is concentrically disposed in outer sleeve 110. Lugs 141 and 143 will extend into mating holes, slots or grooves in end plates 200 and 202, so that when end plates 200 and 202 are bolted in place, jetting sleeve 112 is held in place and fixed against rotation.

The view shown in FIG. 6 shows metering plug 114 in its closed position 201 wherein all of jetting ports 156 are completely covered by a plugging strip 198. The metering plug 114 is rotatable from closed position 201 shown therein to fully open position 203, shown in FIG. 6A, wherein all of the jetting ports 156 are uncovered to allow for a maximum volume therethrough. Positions 201 and 203 of metering plug 114 correspond to closed and fully open positions 111 and 113, respectively, of jetting valve 35.

Figure 4:
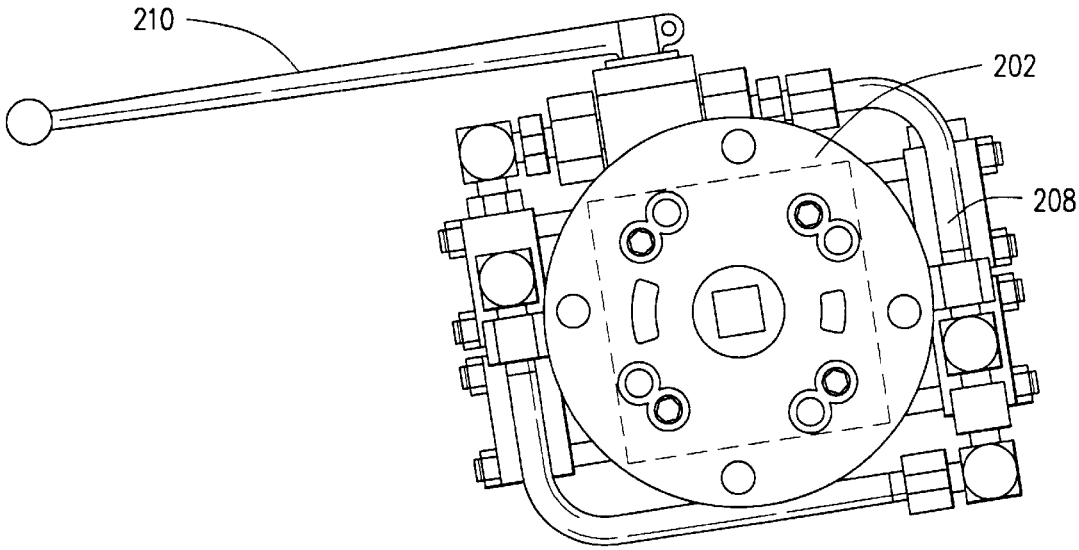
FIG. 4 is a view taken from lines 4—4 of FIG. 1.

Metering plug 114 is rotated clockwise from closed position 201 so that liquid may flow through the exit end 96 of liquid inlet member 20 through openings 136 and 154 and window 196, and through jetting ports 156 and exit opening 134. The liquid will be directed downwardly and inwardly by jetting ports 156 so that the liquid intersects a bulk substance being conveyed through bulk inlet member 25. Generally L-shaped wear rings 206 may be disposed between end plates 200 and 202 and the ends of metering plug 114 to provide for easy rotation. FIG. 4 schematically shows an embodiment of an automatic hydraulic actuator 208 that may be utilized to rotate the metering plug 114. Such actuators are known in the art. Handle 210 can be utilized to provide for a flow path around the automatic hydraulic actuator 208 so that the handle 210 can be attached to the square shaft on the opposite end of the jetting valve 35 to allow for manual rotation of metering plug 114. It is well-known in the art to use hydraulic actuators which can be automatically controlled to regulate the bulk flow rate and the flow of the liquid.

Metering plug 114 can be rotated from closed position 201 to fully open position 203 or can be rotated so as to uncover any desired portion of the jetting ports 156 to regulate the volume of the liquid flow into mixing tube 15. When an automatic actuator is used, it can be connected to a computer and the flow rate of the liquid and bulk cement or other bulk material can be measured, along with the consistency and other characteristics of the mixture. Such information may be transmitted to a database. The position of metering plug 114 along with a valve which controls the flow of the cement or other bulk material can be automatically regulated based on the information, so that the correct mixture and the correct flow rates are obtained. An example of such a system is shown in U.S. Pat. No. 5,027,267 which is incorporated herein by reference. If desired, however, the automatic hydraulic actuator 208 can be rendered inoperable by rotating the handle 210 to create a flow path around the automatic hydraulic actuator 208 so that metering plug 114 can be rotated manually. The jetting valve 35 may also include a flow indicator 207 attached to second shaft extension 190 and an indicator plate 209 attached to end plate 200 for indicating the position of metering plug 114.

Figure 17:
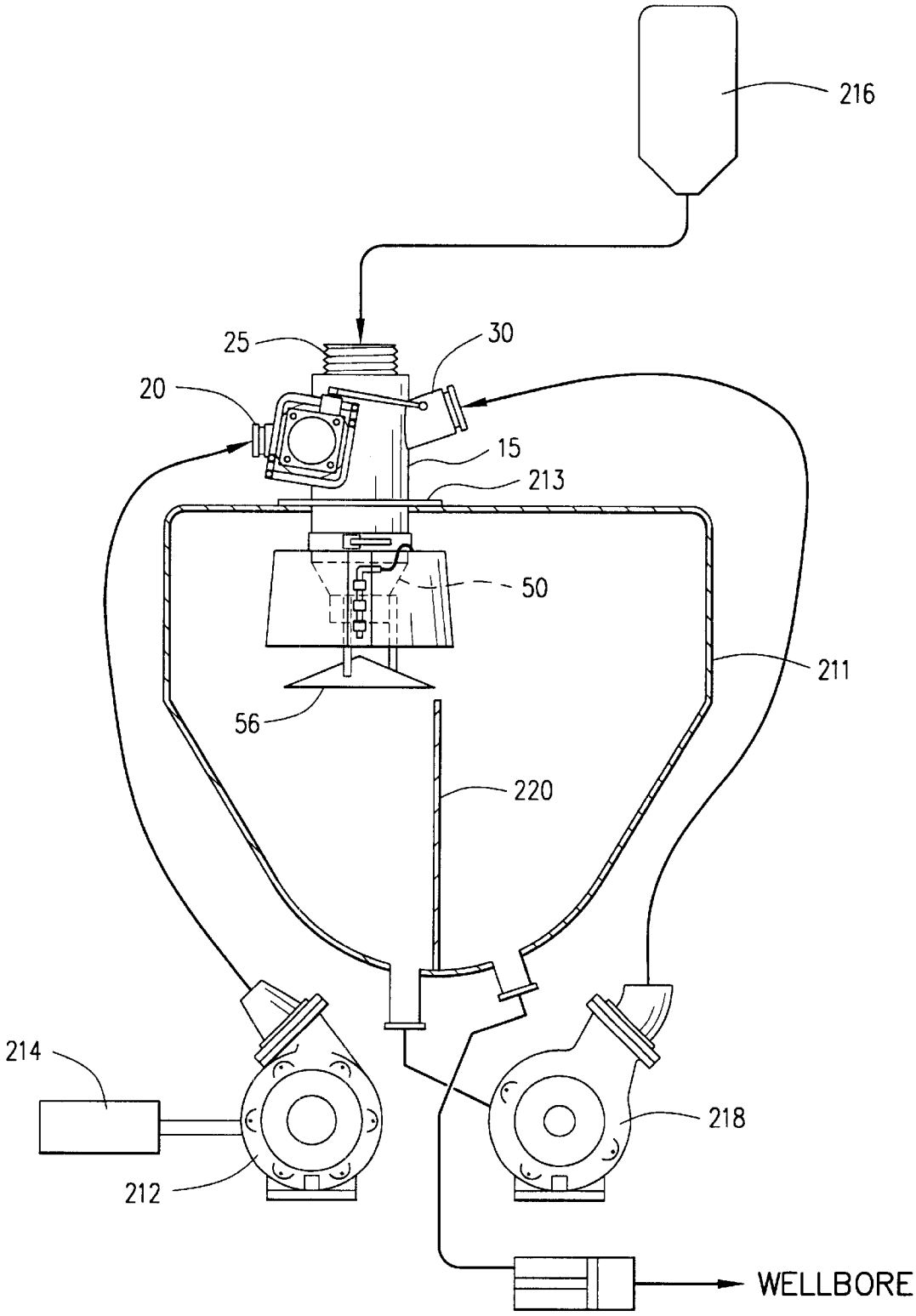
FIG. 17 is a schematic of an apparatus and system of the present invention.

FIG. 17 schematically shows use of the mixing apparatus 10 in a typical cement slurry mixing application. As shown therein, mixing tube 15 is vertically oriented and is attached to a mixing tub 211 which may be a mixing tub of any type known in the art with mounting bracket 213. A pump 212 pumps water from a water storage unit 214 to liquid inlet member 20. Bulk cement enters bulk inlet member 25 from bulk storage unit 216. Pump 218 pumps the cement slurry from mixing tub 211 to recirculation inlet member 30.

The water, cement and recirculated slurry are conveyed into mixing tube 15 where they intersect below lower end 60 of bulk inlet member 25. The mixture formed by the intersection of the substances pass through the lower end 60 of the mixing tube 15 into funnel 50. The mixtures engage deflector cone 56, which deflects and diffuses the mixture in the mixing tub 211. An agitator can be used to circulate and further mix the slurry mixture in the mixing tub 211. The mixing tub 211 will ultimately fill so that slurry will flow over a partition 220 in mixing tub 211 and can be pumped into a wellbore.

The schematic shown herein is similar to the schematic shown in U.S. Pat. No. 5,538,341. However, in the '341 patent, the liquid metering valve is disposed a distance upstream from the liquid inlet member. Mixing energy is lost by utilizing a valve upstream of the inlet member. With the present invention, throttling valve 35 is disposed at the exit end 96 of liquid inlet member 20. The present invention therefore more efficiently utilizes the energy available for mixing.

Nearly all of the potential energy that exists because of the pressure in liquid inlet member 20 will translate to kinetic mixing energy when the jetting valve 35 is opened. In other words, no energy is lost due to positioning the jetting valve 35 upstream of the liquid inlet member 20. The volume of the flow into the mixing tube 15 will increase as the metering plug 114 is rotated from its closed position 201 to its fully open position 203. The metering plug 114 can be positioned at any location between the closed and fully open positions 201 and 203, respectively, to provide for any desired volume flow rate of water. Although the volume of flow increases as the jetting valve 35 is opened, the velocity of the water, while it will decrease slightly when the volume increases, will be substantially constant since the decrease in pressure in the liquid inlet member 20 between the fully closed and fully open positions 201 and 203, respectively, is slight and therefore insignificant.

By utilizing all of the energy available, a better mixing apparatus 10 is provided. Water is directed through jetting ports 156 downwardly and inwardly so that it will intersect with the bulk material, preferably dry cement, below bulk inlet member 25 as it passes vertically downwardly in the mixing tube 15. Such an arrangement will provide for an adequate mixture, even in those cases where for mechanical or other reasons, no recirculation mixture is being recirculated into mixing tube 15 through the recirculation inlet member 30.

While the invention disclosed herein is discussed primarily in the context of mixing a cement slurry at a well site, it will be recognized by those skilled in the art that the apparatus and method for mixing can be used for mixing other substances at a well site as well as in other applications.

Thus, the present invention is well-adapted to carry out the objects and obtain the ends and advantages mentioned as well as those inherent therein. While preferred embodiments of the present invention have been illustrated for the purposes of the present disclosure, changes in the arrangement and construction of parts and the performance of steps can be made by those skilled in the art, which changes are encompassed within the scope and spirit of the present invention as defined by the appended claims.

What is claimed is:

1. A mixing apparatus for forming a mixture of a liquid and a dry substance, the mixing apparatus comprising:

a mixing tube;

a liquid inlet member for conveying the liquid into the mixing tube;

a bulk inlet member for conveying the dry substance into the mixing tube; and a jetting valve disposed between the liquid inlet member and the mixing tube for regulating the flow rate of the liquid into the mixing tube, the jetting valve comprising:

an outer sleeve fixedly attached to the mixing tube, the outer sleeve having a first opening in communication with the liquid inlet member and a second opening in communication with the mixing tube; and a jetting sleeve disposed in the outer sleeve, the jetting sleeve having a entrance opening in communication with the first opening in the outer sleeve and a plurality of jetting ports defined therethrough in communication with the second opening in the outer sleeve;

wherein in an open position of the jetting valve the liquid is permitted to flow from the liquid inlet member through the first opening in the outer sleeve and the entrance opening in the jetting sleeve and out through the jetting ports and the second opening in the outer sleeve into the mixing tube, and wherein in a closed position of the jetting valve no flow of the liquid is permitted through the jetting ports.

2. The mixing apparatus of claim 1 further comprising a recirculation inlet member for conveying the mixture of the liquid and the dry substance back into the mixing tube.

3. The mixing apparatus of claim 1 wherein the jetting valve may be positioned at or between a fully open position wherein a maximum flow rate of the liquid through the jetting valve is permitted and the closed position, and wherein the flow rate is regulated by positioning the jetting valve at the fully open position, the closed position, or a position between the fully open position and the closed position.

4. The mixing apparatus of claim 1 wherein the bulk inlet member has an exit opening for permitting the dry substance to pass therethrough into the mixing tube, wherein the exit opening defines a width, and wherein the jetting ports define a width substantially the same as the width of the exit opening in the bulk inlet member.

5. The mixing apparatus of claim 4 wherein the exit opening in the bulk inlet member is generally circular in shape and defines an exit opening diameter, and wherein the exit opening diameter comprises the width of the exit opening in the bulk inlet member.

6. The mixing apparatus of claim 1 wherein the jetting ports are arranged in a plurality of columns.

7. The mixing apparatus of claim 1 further comprising a metering plug disposed in the jetting sleeve, wherein the metering plug covers the jetting ports to prevent flow of the liquid therethrough when the jetting valve is in the closed position, and wherein the metering plug may be rotated in the jetting sleeve to uncover the jetting ports to permit flow of the liquid therethrough into the mixing tube.

8. The mixing apparatus of claim 7 wherein the metering plug may be rotated so that the jetting valve is in a fully open position wherein all of the jetting ports are uncovered.

9. The mixing apparatus of claim 7 wherein the metering plug has at least one groove adapted to receive a seal for sealing engaging the jetting sleeve.

10. A mixing apparatus comprising:

a mixing tube;

a first inlet member for conveying a liquid into the mixing tube;

a second inlet member for conveying a dry substance into the mixing tube; and a valve connected to the first inlet member for regulating the flow rate of the liquid and for redirecting the flow of the liquid so that it enters the mixing tube at a selected angle from the direction of flow of the dry substance, the valve comprising:

an outer cylinder, the outer cylinder having an inlet opening communicated with the first inlet member and having an outlet opening;

a jetting sleeve concentrically disposed in the outer cylinder, the jetting sleeve having a plurality of jetting ports defined therethrough, wherein in an open position of the valve the liquid is permitted to flow from the first inlet member through the inlet opening in the outer cylinder and through at least a portion of the jetting ports in the jetting sleeve and the outlet opening in the outer cylinder into the mixing tube, and wherein in a closed position of the valve no flow is permitted through the jetting ports; and a metering plug disposed in the jetting sleeve, wherein the metering plug covers the jetting ports to prevent flow therethrough when the valve is in the closed position, and wherein the metering plug may be rotated in the jetting sleeve to uncover the jetting ports to permit flow therethrough into the mixing tube.

11. The mixing apparatus of claim 10 wherein the metering plug maybe rotated so that the valve is in a fully open position wherein all of the jetting ports are uncovered.

12. The mixing apparatus of claim 11 wherein the metering plug is automatically rotatable in the jetting sleeve.

13. A mixing apparatus comprising:

a mixing tube;

a liquid inlet member for conveying a liquid into the mixing tube;

a dry substance inlet member for conveying a dry substance into the mixing tube;

a jetting sleeve communicated with the liquid inlet member, the jetting sleeve having a plurality of jetting ports therethrough, wherein the liquid may be communicated through the liquid inlet member into the jetting sleeve and through the jetting ports into the mixing tube so that it will mix with the dry substance conveyed through the dry substance inlet;

an outer sleeve disposed about the jetting sleeve, the outer sleeve being connected to the liquid inlet member, wherein the liquid is communicated through the outer sleeve and into the jetting sleeve; and a metering plug rotatably disposed in the jetting sleeve, the metering plug being rotatable between open and closed positions, wherein in the closed position the metering plug prevents flow through the jetting ports and wherein in the open position the metering plug permits flow through the jetting ports.

14. The mixing apparatus of claim 13 wherein the metering plug is rotatable between a plurality of partially open positions between the closed position and a fully open position, and wherein the metering plug may be positioned at a selected of the partially open positions.

15. The mixing apparatus of claim 13 wherein the liquid inlet member has a longitudinal axis, and wherein a longitudinal axis of the jetting sleeve is positioned transversely to the longitudinal axis of the liquid inlet member.

16. The mixing apparatus of claim 13 wherein the jetting ports comprise a plurality of jetting ports defined through a side of the jetting sleeve.

17. The mixing apparatus of claim 16 wherein the jetting ports are arranged in a plurality of columns.

* * * * *